US007896566B2

(12) United States Patent
Yanagi

(10) Patent No.: US 7,896,566 B2
(45) Date of Patent: Mar. 1, 2011

(54) PRINTING APPARATUS AND PRINTING METHOD

(75) Inventor: Haruyuki Yanagi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 746 days.

(21) Appl. No.: 11/549,296

(22) Filed: Oct. 13, 2006

(65) Prior Publication Data

US 2007/0140771 A1 Jun. 21, 2007

(30) Foreign Application Priority Data

Dec. 15, 2005 (JP) ..... 2005-362426
Oct. 2, 2006 (JP) ..... 2006-271189

(51) Int. Cl.
*B41J 13/00* (2006.01)
*B41J 2/01* (2006.01)
*B41J 29/46* (2006.01)

(52) U.S. Cl. ..... 400/578; 400/636; 347/16; 347/19; 347/104

(58) Field of Classification Search ..... 400/578, 400/636, 708; 347/16, 104; 399/16; 358/504
See application file for complete search history.

(56) References Cited

U.S. PATENT DOCUMENTS 6,027,211 A 2/2000 Unosawa et al. ..... 347/104
6,092,892 A 7/2000 Taniguro et al. ..... 347/104
6,761,425 B2 7/2004 Kawaguchi et al. ..... 347/16
6,869,241 B2 * 3/2005 Ouchi et al. ..... 400/578
7,021,737 B2 * 4/2006 Yamada ..... 347/19
7,308,853 B2 * 12/2007 Satoh et al. ..... 101/118
2006/0038847 A1 2/2006 Yanagi et al. ..... 347/16

FOREIGN PATENT DOCUMENTS

JP 2002-254736 9/2002
JP 2005-7817 1/2005
JP 2005-313587 11/2005

* cited by examiner

*Primary Examiner*—Ren Yan
*Assistant Examiner*—Marissa L Ferguson-Samreth
(74) *Attorney, Agent, or Firm*—Fitzpatrick, Cella, Harper & Scinto

(57) ABSTRACT

A printing apparatus and method are capable of printing an image in a rear end area of a print medium. A sheet is transported by a transport roller and pinch rollers situated upstream of a print head with respect to the transport direction, and by a discharge roller and spurs situated downstream of the print head. After the sheet has left the transport roller and the pinch rollers, it is transported by the discharge roller and spurs. The sheet is printed with a test pattern for detecting a difference between a transport amount appearing before the sheet leaves the transport roller and pinch rollers and a transport amount appearing when the sheet leaves them. Based on a correction value set according to a printed result of the test pattern, the transport amount used when the sheet leaves the transport roller and pinch rollers is corrected.

3 Claims, 12 Drawing Sheets

PRINTING APPARATUS AND PRINTING METHOD

BACKGROUND OF THE INVENTION

1. Field of the Invention

The present invention relates to a printing apparatus and a printing method capable of correcting a transport amount of a print medium when an image is printed on the print medium with transporting the print medium.

2. Description of the Related Art

In recent years, printing apparatus such as printers are finding a growing range of applications in printing picture images. Particularly, ink jet printers have achieved a significant progress in reducing the size of ink droplets ejected from a print head and thus are able to print images equal to or higher in image quality than silver salt pictures. In such ink jet printers, an image is formed on a sheet (print medium) by transporting the sheet along a transport path passing through a print position that faces the print head and ejecting ink onto the sheet being transported from the print head kept out of contact with the sheet.

To print an image up to a rear end area of the sheet with respect to the transport direction, another transport means (downstream transport means) needs to be provided on a downstream side of the sheet transport direction in addition to a separate transport means (upstream transport means) installed on an upstream side of the sheet transport direction. The upstream and downstream transport means may, for example, be a construction including rollers that hold the sheet in between as they rotate. If the transport means are installed on the upstream and downstream sides of the transport direction, the sheet is first transported only by the upstream transport means. Then, after the front end of the sheet reaches the transport position of the downstream transport means, it is transported by both of the upstream and downstream transport means. After the rear end of the sheet gets out of the transport position of the upstream transport means, it is transported only by the downstream transport means.

In the construction in which the sheet is transported in the sheet transport direction by the upstream and downstream transport means, the print position of an image on the rear end area of the sheet may deviate, degrading an image quality. That is, as the sheet gets out of the upstream transport means, the transport amount of the sheet may greatly vary from a predetermined value, as by backlash of gears in a drive system of the rollers included in the upstream transport means, shifting the print position of the image and degrading the image quality. When the sheet is being transported only by the downstream transport means after the rear end of the sheet has come out of the upstream transport means, a sheet transport accuracy becomes lower than when the sheet is transported by both of the upstream and downstream transport means, making the image print position more likely to deviate, giving rise to a problem of image degradation.

Japanese Patent Laid-Open No. 2002-254736 proposes a method for preventing image degradations in a rear end area of the sheet caused by such a deteriorated transport accuracy in a serial scan type ink jet printing apparatus. This method involves reducing the transport amount before the rear end of the sheet comes out of the upstream transport means situated on the upstream side of the transport direction and, when the rear end of the sheet leaves the upstream transport means and the transport amount of the sheet changes, changing a amount the downstream transport means transports the sheet. Further, a range of nozzles in the print head that are allowed to be used is limited and the positions of the nozzles in operation are shifted at the same time that the transport amount of the sheet is changed.

Further, the transport amount when the sheet is transported only by the downstream transport means is set equal to the transport amount when the rear end of the sheet leaves the upstream transport means so that it is smaller than when the sheet is transported by both the upstream and downstream transport means.

With the construction described in Japanese Patent Laid-Open No. 2002-254736, the image degradations in the rear end area of the sheet can therefore be minimized by reducing the sheet transport errors. That is, when the rear end of the sheet leaves the upstream transport means or during the transporting of the sheet after it has left the upstream transport means, possible reductions in the transport accuracy can be minimized.

SUMMARY OF THE INVENTION

For a further quality enhancement of printed image, however, the printed image degradations in the rear end region of the sheet caused by the deteriorated transport accuracy of the sheet need to be reduced even if condition (for example, roller diameter or friction coefficient of roller) of the printing apparatus is changed from initial condition.

An object of this invention is to provide a printing apparatus and a printing method capable of printing a quality image in the rear end region of the print medium by minimizing a degradation in transport accuracy of the sheet as the rear end of the sheet leaves the upstream transport means situated on the upstream side of the transport direction or during the sheet transporting after it has left the upstream transport means.

In a first aspect of the present invention, there is provided a printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

printing means for printing on the print medium a test pattern used to detect a difference between a transport amount in a first transporting operation and a transport amount in a second transporting operation, the first transporting operation transporting the print medium by the first transport means and the second transport means, the second transporting operation transporting the print medium in which a transporting state is switched from a transporting state of the first transporting operation to a transporting state transporting the print medium not by the first transport means but by the second transport means; and correction means for correcting the transport amount in the second transporting operation based on a printed result of the test pattern.

In a second aspect of the present invention, there is provided a printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

printing means for printing on the print medium a test pattern used to detect a difference between a transport amount in a first transporting operation and a transport amount in a second transporting operation, the first transporting operation transporting the print medium by the first transport means and the second transport means, the second transporting operation transporting the print medium not by the first transport means but by the second transport means; and correction means for correcting the transport amount in the second transporting operation based on a printed result of the test pattern.

In a third aspect of the present invention, there is provided a printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

detecting means for detecting a transport amount in a first transporting operation and a transport amount in a second transporting operation, the first transporting operation transporting the print medium by the first transport means and the second transport means, the second transporting operation transporting the print medium in which a transporting state is switched from a transporting state of the first transporting operation to a transporting state transporting the print medium not by the first transport means but by the second transport means; and correction means for correcting the transport amount in the second transporting operation based on a result of detection by the detection means.

In a fourth aspect of the present invention, there is provided a printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

detection means for detecting a transport amount in a first transporting operation and a transport amount in a second transporting operation, the first transporting operation transporting the print medium by the first transport means and the second transport means, the second transporting operation transporting the print medium not by the first transport means but by the second transport means; and correction means for correcting the transport amount in the second transporting operation based on a result of detection by the detection means.

In a fifth aspect of the present invention, there is provided a printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

printing means for printing on the print medium a test pattern used to detect a difference between transport amounts of the print medium in a first transporting operation and a second transporting operation or a difference between transport amounts of the print medium in the first transporting operation and a third transporting operation; and correction means for correcting the transport amount in the second transporting operation or the transport amount in the third transporting operation based on a printed result of the test pattern;

wherein the first transporting operation is a transporting operation for transporting the print medium by the first transport means and the second transport means;

wherein the third transporting operation is a transporting operation for transporting the print medium not by the first transport means but by the second transport means;

wherein the second transporting operation is a transporting operation interposed between the first transporting operation and the third transporting operation.

In a sixth aspect of the present invention, there is provided a printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

detection means for detecting any one of transport amounts of the print medium in a first transporting operation and a second transporting operation, transport amounts of the print medium in the first transporting operation and a third transporting operation, or transport amounts of the print medium in the first transporting operation, the second transporting operation and the third transporting operation; and correction means for correcting the transport amount in the second transporting operation or the third transporting operation based on a result of detection by the detection means;

wherein the first transporting operation is a transporting operation for transporting the print medium by the first transport means and the second transport means;

wherein the third transporting operation is a transporting operation for transporting the print medium not by the first transport means but by the second transport means;

wherein the second transporting operation is a transporting operation interposed between the first transporting operation and the third transporting operation.

In a seventh aspect of the present invention, there is provided a printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

correction means for correcting a transport amount in a second transporting operation based on a correction value, the correction value being set according to a difference between a transport amount in a first transporting operation and the transport amount in the second transporting operation, the first transporting operation transporting the print medium by the first transport means and the second transport means, the second transporting operation including a transporting state transporting the print medium not by the first transport means but by the second transport means.

In a eighth aspect of the present invention, there is provided a printing method for printing an image on a print medium by repetitively performing a scan operation that scans a print head in a scan direction and a transport operation that transports the print medium in a transport direction crossing the scan direction, the printing method comprising the steps of:

transporting the print medium by a first transport means installed upstream of the print head with respect to the transport direction or by a second transport means installed downstream of the print head with respect to the transport direction; and correcting a transport amount in a second transporting operation based on a correction value, the correction value being set according to a difference between a transport amount in a first transporting operation and the transport amount in the second transporting operation, the first transporting operation transporting the print medium by the first transport means and the second transport means, the second transporting operation including a transporting state transporting the print medium not by the first transport means but by the second transport means.

According to this invention, the transport amount of the sheet is corrected when the rear end of the sheet leaves the upstream transport means situated on the upstream side of the transport direction or during the sheet transporting after it has left the upstream transport means. This minimizes degradations in the sheet transport accuracy and thereby enables a quality image to be formed in a rear end area of the print medium.

Further features of the present invention will become apparent from the following description of exemplary embodiments (with reference to the attached drawings).

DESCRIPTION OF THE EMBODIMENTS

Now, embodiments of this invention will be described by referring to the accompanying drawings.

First Embodiment

Figure 1:
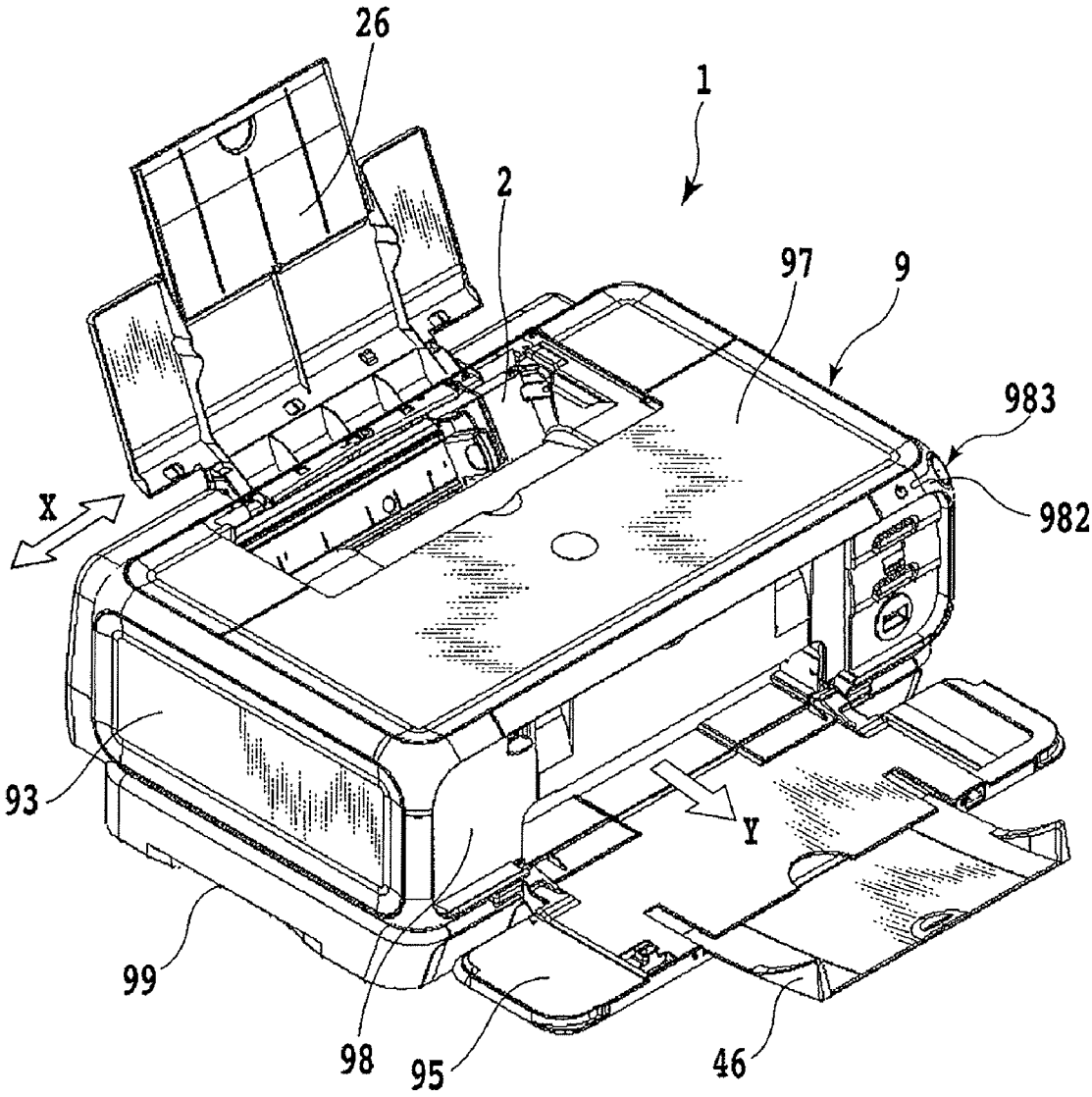
FIG. 1 is a perspective view of a printing apparatus in a first embodiment of this invention.
Figure 2:
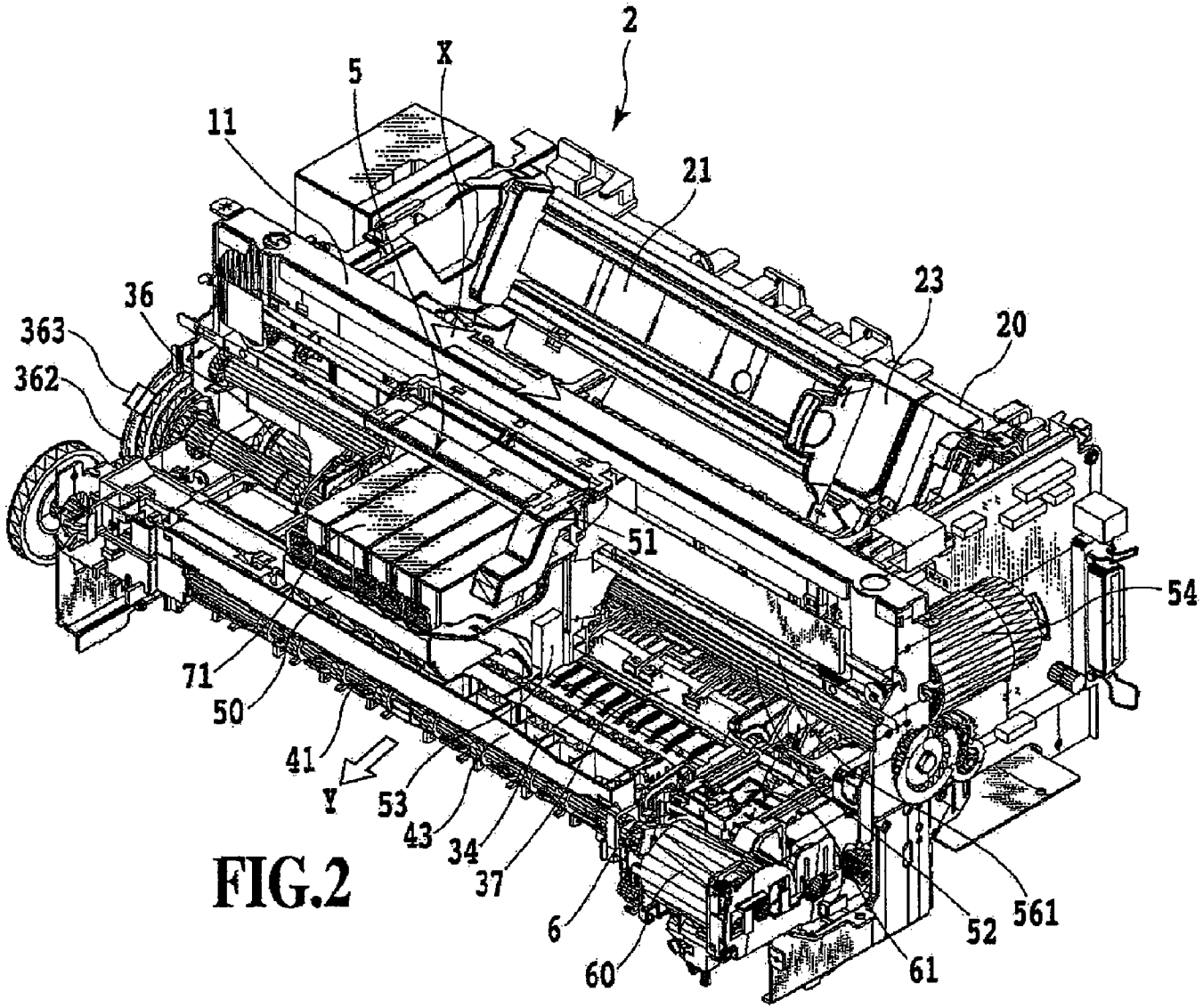
FIG. 2 is a perspective view showing a mechanism in the printing apparatus of FIG. 1.
Figure 3:
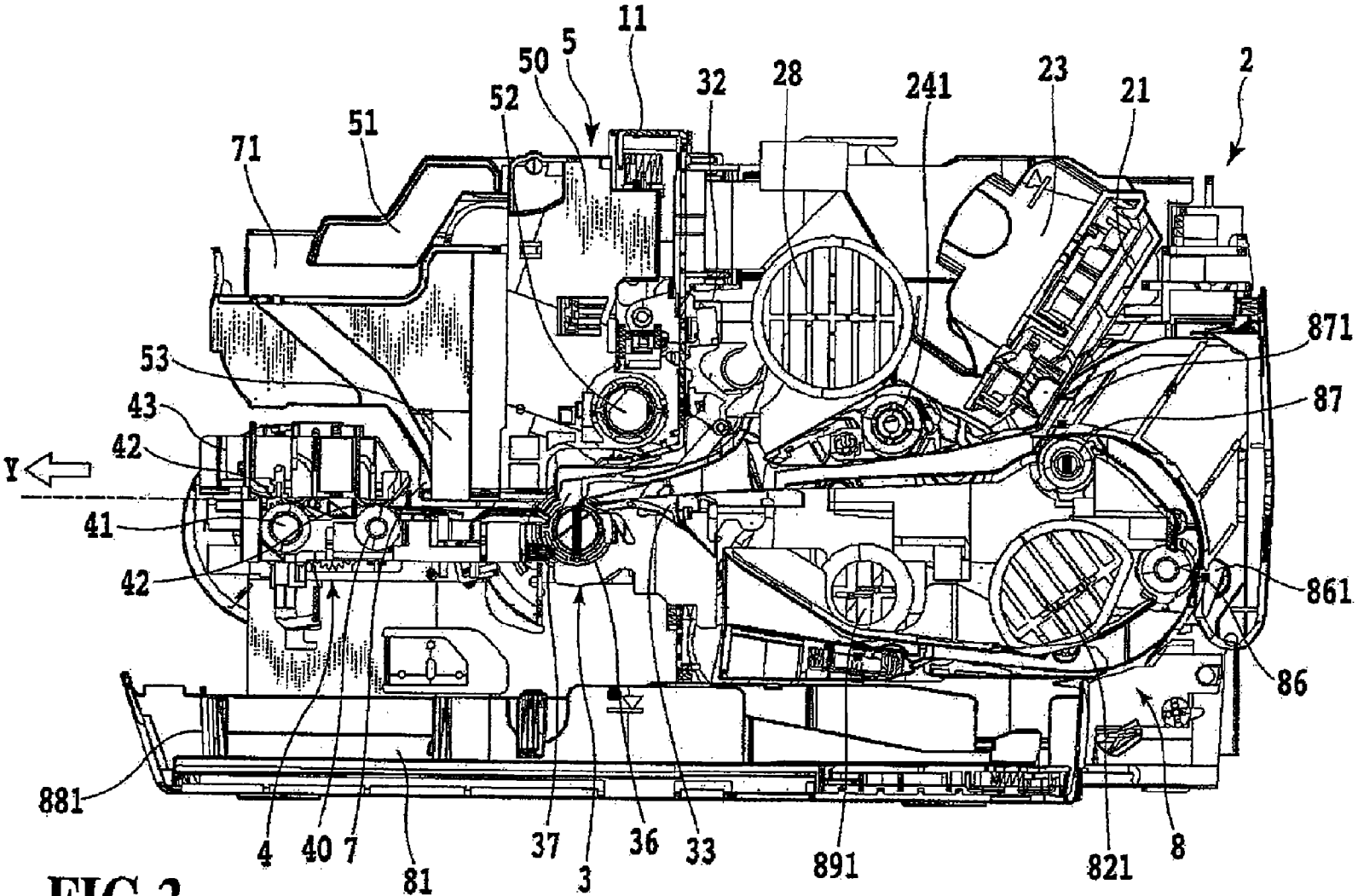
FIG. 3 is a cross-sectional view of the printing apparatus of FIG. 1.
Figure 4:
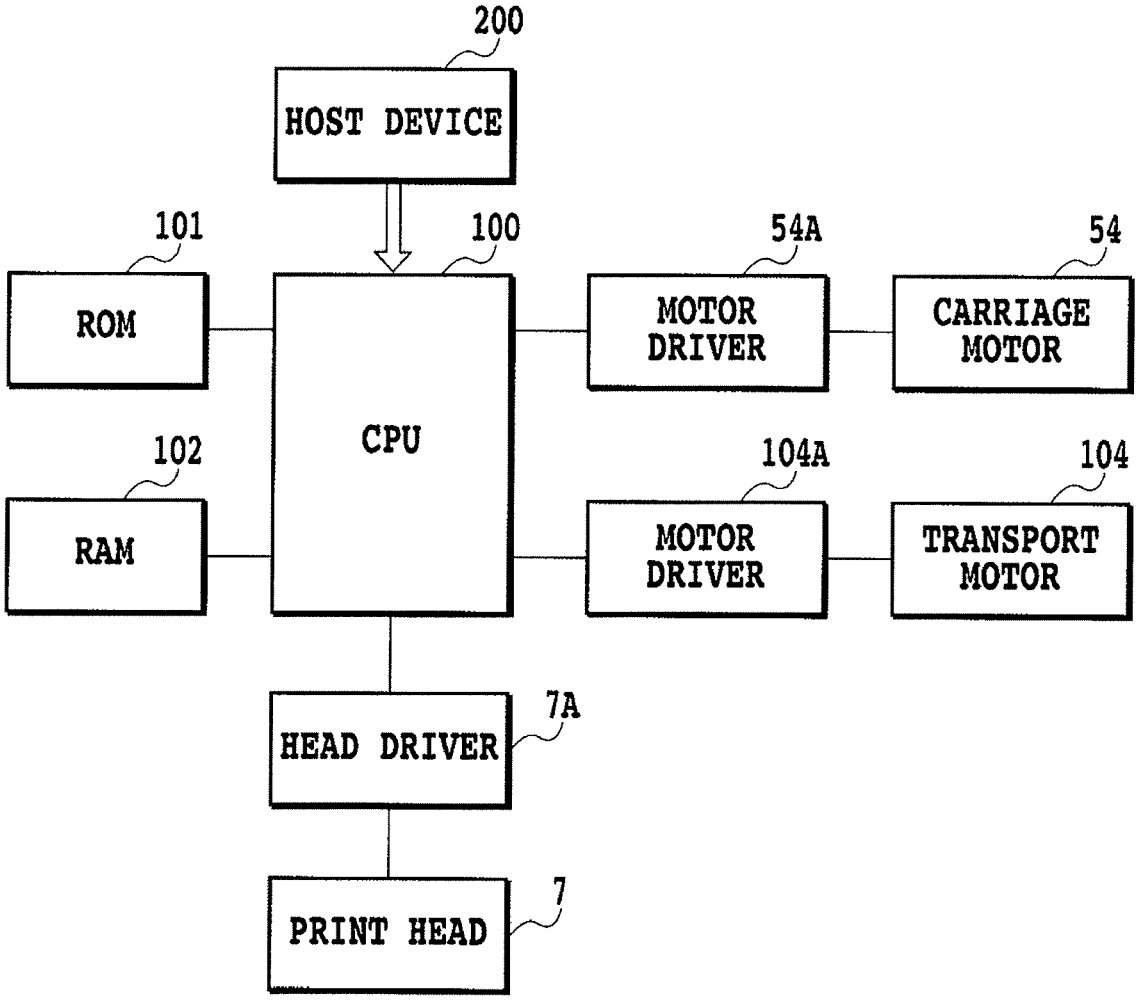
FIG. 4 is a block configuration diagram of a control system in the printing apparatus of FIG. 1.

FIG. 1 through FIG. 7B represent the first embodiment of this invention. FIG. 1 is a perspective view of a printing apparatus to which this embodiment can be applied; FIG. 2 is a perspective view showing a mechanism of the printing apparatus; FIG. 3 is a cross-sectional view of the printing apparatus; FIG. 4 is a block configuration diagram of a control system of the printing apparatus; and FIGS. 5 to 7B are explanatory diagrams showing a transport amount correction control.

The printing apparatus 1 of this embodiment comprises a paper feed unit 2, a paper transport unit 3, a carriage unit 5, a paper discharge unit 4, an automatic U-turn transport unit 8, a cleaning unit 6 for a print head 7, and an enclosure 9. Each of these components will be explained as follows (see FIG. 1 to FIG. 3).

(A) Paper Feed Unit

A base 20 of the paper feed unit 2 is provided with a pressure plate 21 for stacking sheets (of print medium) P, a paper feed roller 28 for feeding sheets P, a separation roller 241 for separating sheets P, and a return lever (not shown) to return sheets P to the stack position. A feed tray 26 for holding the stacked sheets P is mounted on the base 20 or the enclosure. The feed tray 26 is of multistage type and is drawn out for use.

The paper feed roller 28 is a rod arc-shaped in cross section which has a separation roller rubber near a reference position of sheet to feed the sheet. A motor installed in the paper feed unit 2 and commonly used also by the cleaning unit 6 (hereinafter referred to also as a "transport motor") transmits a drive force to the paper feed roller 28 through a drive force transmission gear and a planetary gear not shown.

The pressure plate 21 has a movable side guide 23 which limits the stack position of the sheets P. The pressure plate 21 is rotatable about a rotating shaft connected to the base 20 and is urged by a pressure plate spring not shown toward the paper feed roller 28. A part of the pressure plate 21 facing the paper feed roller 28 is provided with a separation sheet of a material having a large friction coefficient, such as artificial leather, to prevent two or more sheets P from being fed at one time. The pressure plate 21 is driven by a pressure plate cam not shown to engage and disengage from the paper feed roller 28.

Further, a separation roller holder mounted with the separation roller 241 to separate sheets P one at a time is rotatable about a rotating shaft mounted to the base 20 and is urged toward the paper feed roller 28 by a separation roller spring not shown. The separation roller 241 has a clutch spring that allows a portion of the holder attached with the separation roller 241 to rotate when applied with more than a predetermined load. The separation roller 241 is driven by a separation roller release shaft and a control cam not shown to engage and disengage from the paper feed roller 28. The positions of the pressure plate 21, the return lever not shown to return the sheets P to the stack position and the separation roller 241 are detected by an ASF (auto sheet feeder) sensor not shown.

The return lever to return the sheets P to the stack position is rotatably mounted on the base 20 and is urged in a release direction by a return lever spring not shown. Further, the return lever is pivoted by the control cam when returning the sheets P to the stack position.

In a normal standby state, the pressure plate 21 is released by the pressure plate cam, the separation roller 241 is released by the control cam and the return lever blocks a stack opening so as to prevent the sheets P from moving further inward when they are stacked. When, in this state, the paper feed operation starts, the motor drives the separation roller 241 to engage the paper feed roller 28. Then, the return lever is released and the pressure plate 21 engages the paper feed roller 28. In this state the sheets P begin to be fed. The sheets P are restricted by a front stage separation unit provided on the base 20 and only a predetermined number of sheets P are fed to a nip portion formed by the paper feed roller 28 and the separation roller 241. The sheets P are separated by the nip portion and only the top sheet P is fed.

When the sheet P reaches a position of a transport roller 36 and pinch rollers 37, the pressure plate 21 is released by the pressure plate cam and the separation roller 241 is released by the control cam. The return lever is returned to the stack position by the control cam. At this time the sheets P that have reached the nip portion between the paper feed roller 28 and the separation roller 241 can be returned to the stack position.

(B) Paper Transport Unit

The paper transport unit 3 is mounted on a chassis 11 formed of a bent metal plate. The paper transport unit 3 has the transport roller 36 for transporting sheets P and a PE (paper end) sensor not shown. The transport roller 36 is a metal shaft coated with fine ceramic particles on its surface and the metal portions of the shaft ends are mounted on the chassis 11 through bearings. To assure a stable transport by applying a load to the transport roller 36 during its rotation, a transport roller tension spring is provided between the transport roller 36 and its bearing to give a bias to the transport roller 36 to apply a predetermined load.

The transport roller 36 is engaged with a plurality of pinch rollers 37 that are driven by the transport roller. The pinch rollers 37 are pressed against the transport roller 36 by a pinch roller spring biasing the pinch roller holder to generate a sheet P transporting force. The pinch roller holder holds the pinch rollers 37 and rotates about bearings of the chassis. At an inlet of the paper transport unit 3 to which the sheets P are transported, a paper guide flapper 33 to guide the sheets P and a platen 34 are installed. The pinch roller holder is provided with a PE sensor lever that is operated by the front and rear ends of the sheet P as they pass, activating the PE sensor 32. The platen 34 is mounted and positioned on the chassis 11. The paper guide flapper 33 is rotatable about predetermined bearing portions in the transport roller 36 and is positioned when it engages the chassis 11.

In this construction, the sheet P fed to the paper transport unit 3 is guided by the pinch roller holder and the paper guide flapper 33 and fed between the transport roller 36 and the pinch rollers 37. By detecting the front end of the sheet P based on the operation of the PE sensor lever, the print position of the sheet P is set. As the rollers 36, 37 are driven by the transport motor, the sheet P is transported over the platen 34, which is formed with ribs that form a reference surface for transporting the sheet P.

A drive force of the transport motor (DC motor) is transmitted to the transport roller 36 through a timing belt and a pulley. On the rotating shaft of the transport roller 36 is provided a code wheel 362 that is formed with marks at 150-300 lpi (line per inch). The chassis 11 is mounted with an encoder sensor 363 that detects the marks on the code wheel 362 to determine the amount of transport by the transport roller 36. The transport motor is provided with an encoder and, according to a pulse signal representing a slit position or slit number of the encoder, is rotated a predetermined angle stepwise. In the sheet transport amount correction control described later, the pulse signal representing the slit position or slit number is changed according to a correction value to correct the transport amount of the sheet P.

On a downstream side of the transport roller 36 in the transport direction of the sheet P, the print head 7 to form an image according to image information is installed. As the print head 7 an ink jet print head is used which allows a plurality of ink tanks 71 of different color inks to be replaced individually. This print head 7 can apply heat to ink by an electrothermal transducer (heater). The heat causes a film boiling in ink and a pressure change generated by an expansion or contraction of a bubble in ink is used to eject ink from each nozzle in the print head 7 to form an image on the sheet P. The construction of the print head 7 is not particularly limited. It may be an ink jet print head using a piezoelectric element to eject ink or a thermosensitive print head.

(C) Carriage Unit

The carriage unit 5 has a carriage 50 in which the print head 7 can be mounted. The carriage 50 is guided by a guide shaft 52 and a guide rail 11 so that it can be moved in a main scan direction X. The main scan direction crosses the transport direction Y of the sheet P (in this case, at right angles).

The carriage 50 is driven by a carriage motor 54 mounted on the chassis 11 through a timing belt. To detect the position of the carriage 50, a code strip 561 formed with marks at a pitch of 150-300 lpi is provided parallel to the timing belt, and a carriage substrate attached with an encoder sensor is mounted on the carriage 50. The encoder sensor reads the marks on the code strip 561. The print head 7 is fixed to the carriage 50 by pivoting a head set lever 51. The carriage 50 is mounted with an automatic registration sensor that optically reads a pattern printed on the sheet P to adjust landing positions of ink droplets ejected from the print head 7.

In this construction, an image is formed on the sheet P by transporting the sheet P to the image forming position by the rollers 36, 37 and ejecting ink from the print head 7 while the carriage unit 5 is moved in the main scan direction by the carriage motor.

(D) Paper Discharge Unit

The paper discharge unit 4 comprises two discharge rollers 40, 41, spurs 42 engaged with and driven by these rollers, and a gear train to transmit the rotating force of the transport roller 36 to the discharge rollers 40, 41.

The discharge rollers 40, 41 are mounted to the platen 34. The discharge roller 40 situated on the upstream side of the transport direction of the sheet P is driven by the rotating force of the transport roller 36 transmitted through an idler gear. To the discharge roller 41 situated on the downstream side of the discharge roller 40 a drive force is transmitted from the discharge roller 40 through an idler gear.

The spurs 42 are thin SUS plates having protruding portions at their periphery and formed integral with a resin portion. They are attached to a spur holder 43. The spurs 42 are attached to the spur holder 43 by spur springs and pressed against the discharge rollers 40, 41 by a biasing force of the spur springs. The spurs 42 include ones having first and second functions. The first function is mainly to generate a sheet P transporting force by arranging the spurs at positions corresponding to the elastic portions such as rubber portions of the discharge rollers 40, 41. The second function is to keep the paper P from floating as the sheet P is printed, by arranging the spurs at positions facing other than the elastic portions 411 of the discharge rollers 40, 41. A paper end support for holding both ends of the sheet P at elevated positions is arranged between the discharge rollers 40 and 41.

In this construction, the sheet P formed with an image by the carriage unit 5 is gripped by the nip portion between the discharge roller 40 and the spurs 42 and the nip portion between the discharge roller 41 and the spurs 42 and transported and discharged onto a discharge tray 46. The discharge tray 46 is accommodated in a front cover 95 and drawn out for use, as shown in FIG. 1. The discharge tray 46 is formed such that it is higher toward the front end, with both sides raised, to improve a stacking performance of the discharged sheets P and prevent the printed surface from being rubbed and smeared.

(E) Automatic U-Turn Transport Unit

The cassette 81 provided on the front side of the apparatus accommodates the sheets P. To separate the sheets P for feeding, the cassette 81 has a pressure plate that presses the sheet P against the feed roller 821. A UT base of the apparatus body is provided with the feed roller 821 for feeding the sheet P, a separation roller for separating the individual sheets P, a return lever for returning the sheets P to the stack position, and a means for controlling the pressing action on the pressure plate.

The cassette 81 has a two-stage contractible construction that can be used in different ways according to the size of the sheets P. When the sheets P is small in size or when the cassette is not in use, the cassette 81 is contracted and accommodated in the enclosure 9 of the apparatus body.

The feed roller 821 is a bar arc-shaped in cross section and has a separation roller rubber near a reference position of the sheet for sheet feeding. An automatic U-turn transport motor installed in the automatic U-turn transport unit 8 transmits a drive force to the feed roller 821 through a transmission gear and planetary gear.

The pressure plate is provided with a movable side guide that restricts the stack position of the sheets P. The pressure plate is rotatable about a rotating shaft connected to the cassette 81 and is urged toward the feed roller 821 by a pressing and control means that is installed on the UT base and made up of a pressure plate spring. A part of the pressure plate facing the feed roller 821 is provided with a separation sheet of a material having a large friction coefficient, such as artificial leather, to prevent two or more sheets near the bottom from being fed at one time. The pressure plate is driven by a pressure plate cam to engage and disengage from the feed roller 821.

A separation roller holder having a separation roller to separate sheets P one at a time is rotatable about a rotating shaft mounted to the separation base and is urged toward the feed roller 821 by a separation roller spring. The separation roller has a clutch spring that allows a portion of the holder attached with the separation roller to rotate when applied with more than a predetermined load. The separation roller is driven by a separation roller release shaft and a control cam to engage and disengage from the feed roller 821. The positions of the pressure plate, the return lever and the separation roller are detected by a UT sensor.

The return lever to return the sheets P to the stack position is rotatably mounted on the UT base and is urged in a release direction by a return lever spring. Further, the return lever is pivoted by the control cam when returning the sheets P to the stack position.

In a normal standby state, the pressure plate is released by the pressure plate cam and the separation roller is released by the control cam. The return lever returns the sheets P and blocks a stack opening so as to prevent the sheets P from moving further inward when they are stacked. When, in this state, the paper feed operation starts, the motor drives the separation roller to engage the feed roller 821. Then, the return lever is released and the pressure plate 21 engages the feed roller 821. In this state the sheets P begin to be fed. The sheets P are restricted by a front stage restriction means provided on the base and only a predetermined number of sheets P are fed to a nip portion formed by the feed roller 821 and the separation roller 831. The sheets P thus fed are separated by the nip portion and only the top sheet P is fed.

When the sheet P that was separated and fed reaches a position of a U-turn intermediate roller (1) 86 and a U-turn pinch roller 861, the pressure plate is released by the pressure plate cam and the separation roller is released by the control cam. The return lever is returned to the stack position by the control cam. At this time, the sheets P that have reached the nip portion between the feed roller 821 and the separation roller can be returned to the stack position.

On the downstream side of the paper feed unit, two transport rollers, i.e., the U-turn intermediate roller (1) 86 and a U-turn intermediate roller (2) 87 are arranged to further transport the sheet P that has been fed. These rollers include metal shafts having EPDM of rubber hardness of 40-80° attached to four to six locations on their cores. At positions corresponding to the rubber portions U-turn pinch rollers 861, 871 are mounted by spring shafts. These U-turn pinch rollers 861, 871 are urged toward the corresponding U-turn intermediate roller (1) 86 and U-turn intermediate roller (2) 87. An inner guide is arranged on the inner side of the transport path of the sheet P, and an outer guide is arranged on the outer side of the transport path.

At a merge point between the transport path and the paper feed unit 2 there is a flapper that is constructed to ensure that their paths merge smoothly. When the front end of the sheet P is fed between the transport roller 36 and the pinch rollers 37, it engages the nip portion of the roller pairs at rest so as to perform the sheet registration operation (positioning operation).

The sheet P that was printed as it was transported by the transport roller 36 and the pinch rollers 37 now passes between the rollers. In an automatic two-sided printing that prints both the front and back sides of the sheet P, the rear end of the sheet P is gripped between the transport roller 36 and the pinch rollers 37 and transported again. At this time, the pinch rollers 37 are moved up by a raise/lower mechanism 884 to allow the sheet P to be transported smoothly.

The sheet P that was fed again is gripped between a two-sided printing roller 891 and pinch rollers and transported, guided by a guide member. The transport path for the two-sided printing merges with the U-turn transport path, and the operation of the transport path after the merge is the same as described above.

(F) Cleaning Unit

The cleaning unit 6 comprises a pump 60 to clean the print head 7, a cap 61 to keep the print head 7 from drying, and a blade to clean a face (nozzle forming surface) of the print head 7 in which nozzle openings are formed.

The cleaning unit 6 is driven mainly by the transport motor described above. The cleaning unit 6 has a one-way clutch that basically allows the pump 60 to be operated when the transport motor rotates in one direction and also allows the blade to be operated and the cap 61 to be raised or lowered when it rotates in the opposite direction.

The pump 60 generates a negative pressure by squeezing two tubes with a pump roller. The pump 60 is connected to the cap 61 through a valve or the like. With the cap 61 in hermetic contact with the print head 7, the pump 60 is activated to suck out unnecessary ink from the print head 7. The cap 61 is provided with an ink absorbent to minimize the amount of ink remaining on the face of the print head 7 after the suction operation. To prevent the ink remaining in the absorbent from solidifying and causing troubles, the ink remaining in the cap 61 is drawn out with the cap open. The waste ink sucked out by the pump 60 is absorbed and held in a waste ink absorbent provided in a lower case.

A series of operations, including the operation of the blade and the raise/lower operation of the cap 61, is controlled by a main cam having a plurality of cams on the shaft. With the main cam acting on the cams and arms, the predetermined operations are performed. The position of the main cam can be detected by a position sensor such as photo interrupter. When the cap 61 is lowered, the blade is moved perpendicular to the scan direction of the carriage unit 5 to clean the face of the print head 7. Two or more of the blades are provided, of which one is assigned to clean the nozzle openings and another cleans the entire face of the print head. When the blades have moved to the farthest end of their stroke, they engage a blade cleaner that removes ink adhering to the blades.

A drive force to open and close the valve between the pump 60 and the cap 61 is transmitted and controlled in connection with the rotation of the discharge roller 40. Two or more of the caps 61 are provided to match a plurality of faces formed with nozzles that eject different colors of inks. These caps 61 are connected to the pump 60 through the associated valves. Therefore, by selectively controlling these valves, it is possible to perform an overall ink suction for all colors and individual suctions of desired ink colors as the situation demands. The positions of these valves are detected by valve position sensors.

(G) Enclosure

These units of the above constructions are built into the chassis 11 to form the mechanism portion of the printer. An enclosure is arranged to enclose the chassis 11. The enclosure comprises mainly a lower case 99, an upper case 98, an access cover 97, a connector cover, a front cover 95 and side covers 93.

The front cover 95 accommodates the discharge tray 46 so that the discharge tray can be retracted and drawn out. When the printer is not in use, the paper discharge opening is closed. The open or closed state of the front cover 95 is detected by a sensor not shown.

The access cover 97 is rotatably attached to the upper case 98. The upper case 98 has an opening in a part of its top surface, through which the ink tanks 71 and the print head 7 can be replaced. Further, to detect the opening and closing action of the access cover 97, the upper case 98 has a door switch lever, an LED guide 982 to transmit and display LED light and a key switch 983 to act on a switch of the substrate. The upper case 98 also has the feed tray 26 rotatably mounted thereon. When the paper supply unit is not in use, the feed tray 26 is retracted to be used as a cover of the paper supply unit.

The upper case 98 and the lower case 99 are mounted by elastic engagement claws. Portions of these cases 98, 99 where connectors are provided are enclosed by a connector cover.

The side covers 93 are mounted to left and right sides of the apparatus body to cover the upper case 98 and the lower case 99.

(Configuration of Control System)

FIG. 4 is an outline block configuration of a control system in the printing apparatus that can apply the present invention.

In FIG. 4, a CPU 100 executes control processing on the operations of the printing apparatus, including the correction control of the transport amount described later, and data processing. A ROM 101 stores programs dictating the procedures of these processing. A RAM 102 is used as a work area by the CPU when executing the processing. The print head 7 ejects ink according to drive data (image data) and a drive control signal (heat pulse signal) for heating elements. These data and signal are supplied to a head driver 7A by the CPU 100. The CPU 100 controls the carriage motor 54 for driving the carriage 50 in the main scan direction through a motor driver 54A and also controls the transport motor 104 for transporting the sheet P in the transport direction through a motor driver 104A.

(Transport Amount Correction Control)

Next, the control to correct the transport amount of the sheet P will be explained by referring to FIG. 5 to FIG. 7B.

As described earlier, the sheet P is fed from the paper feed unit 2 or the cassette 81 on the front side. The sheet P fed is transported a predetermined amount by the transport roller 36 and then printed by the print head 7 mounted on the carriage 50. In a full width printing (marginless printing), the ink ejected outside the edges of the sheet P is absorbed in the platen absorbent on the platen 34. That is, all the ink that was ejected outside the four side edges of the sheet P is absorbed in the platen absorbent. As the printing operation proceeds, the rear end Pr of the sheet P approaches and comes out of the nip portion between the transport roller 36 and the pinch rollers 37. At this time, backlashes of gears in the roller drive system and an outer diameter difference between the transport roller 36 and the discharge roller 40 may cause the transport amount of the sheet P to deviate greatly from a predetermined amount. After the rear end Pr of the sheet P has come out of the nip portion between the transport roller 36 and the pinch rollers 37, the transport accuracy of the sheet P is determined by the outer diameter accuracy of the discharge roller 40.

Depending on the code wheel 362 directly connected to the transport roller 36 and the encoder sensor 363, the minimum unit of the transport amount of the sheet P is, for example, 600 dpi (4.2 μm).

The carriage 50 is mounted with a reflection type transport amount correction sensor 53 composed of a light emitting element and a light receiving element. With this sensor 53, the pattern printed on the sheet P can be read. The sensor 53 also doubles as a paper width sensor or a position sensor during a CD-R direct printing operation.

Next, a series of operations performed to correct the transport amount of the sheet P will be explained.

Figure 5:
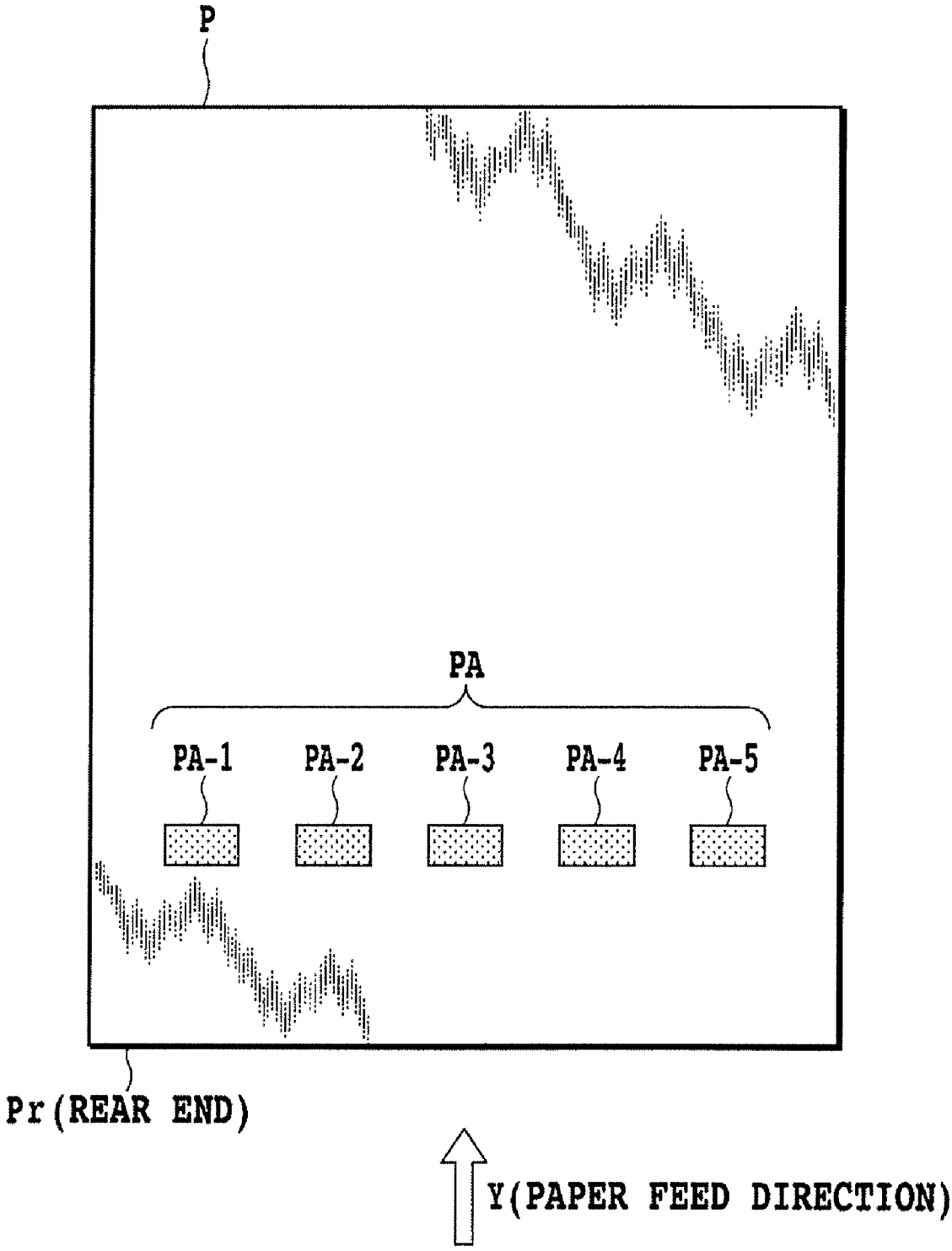
FIG. 5 is an explanatory diagram showing an example of a printed test pattern in the first embodiment of this invention.

The sheet P set in the paper feed unit 2 or cassette 81 is fed to the position of the transport roller 36 which in turn transports the sheet. In this state, a test pattern is printed. This test pattern is used for correcting the transport amount of the sheet when the rear end Pr of the sheet P comes out of the nip portion between the transport roller 36 and the pinch rollers 37. This test pattern, as shown in FIG. 5, is printed on the sheet P at a position near its rear end Pr. That is, the test pattern PA is printed in five blocks (PA-1 to PA-5) arrayed in the scan direction (X direction) of the carriage 50.

The test pattern PA is printed in two scans of the print head 7 as follows.

Figure 6A:
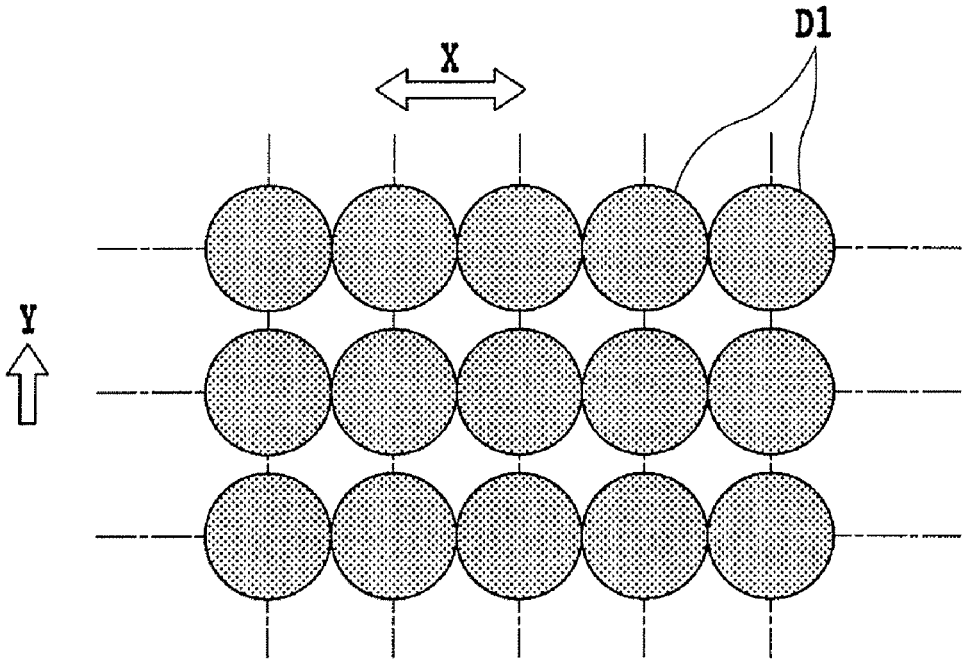
FIG. 6A is an explanatory diagram showing first dots in the test pattern of FIG. 5

First, the rear end Pr of the sheet P is detected by the PE sensor and, based on the detection timing, the time when the rear end Pr comes out of the nip portion between the transport roller 36 and the pinch rollers 37 is determined. Then, in the first scan immediately before the rear end Pr of the sheet P comes out of the nip portion between the transport roller 36 and the pinch rollers 37, first-applied dots D1 are formed as shown in FIG. 6A. These first-applied dots D1 are formed simultaneously in five blocks PA-1 to PA-5.

Figure 6B:
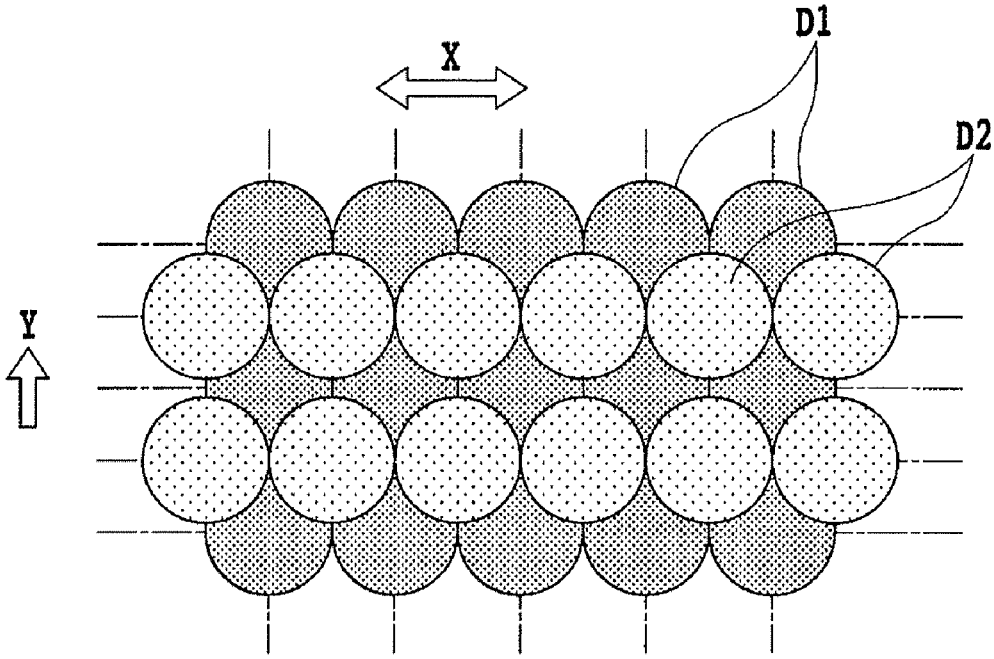
FIG. 6B is an explanatory diagram showing second dots in the test pattern of FIG. 5.

Next, the sheet P is transported a predetermined amount by the transport roller 36 to cause the rear end Pr to come out of the nip portion between the transport roller 36 and the pinch rollers 37. Then, in a second scan of the print head 7 as shown in FIG. 6B, subsequent dots D2 are formed to overlap the first-applied dots D1 of FIG. 6A. In this case, the subsequent dots D2 can be formed by transporting the sheet P half the length of the nozzle column of the print head 7 after the first-applied dots D1 have been formed in the first scan and then performing the second scan of the print head 7.

In forming the subsequent dots D2 in the five blocks PA-1 to PA-5 following the printing of the first-applied dots D1 in the first scan, the transport amount of the sheet P is changed. When the five blocks PA-1 to PA-5 are printed in the order from left to right, for example, the subsequent dots D2 are formed as follows.

First, the first-applied dots D1 are formed in the five blocks PA-1 to PA-5 in the first scan and then the sheet P is transported an amount which is (2×Aμm) shorter than a predetermined transport amount, after which the subsequent dots D2 are formed in the first block PA-1. The predetermined transport amount of the sheet P is determined in advance for intermittent transporting of the sheet P in a serial scan type printing apparatus.

Next, the carriage 50 is stopped temporarily and the sheet P is transported an amount of Aμm, after which the subsequent dots D2 are formed in the second block PA-2. Next, the carriage 50 is stopped temporarily and the sheet P is transported Aμm, after which the subsequent dots D2 are formed in the third block PA-3. Next, the carriage 50 is stopped temporarily and the sheet P is transported Aμm, after which the subsequent dots D2 are formed in the fourth block PA-4. Then, the carriage 50 is stopped temporarily and the sheet P is transported Aμm, after which the subsequent dots D2 are formed in the fifth block PA-5.

Therefore, the subsequent dots D2 in the blocks PA-1 and PA-2 are formed after the sheet P has been transported amounts, which are (2×A)μm and Aμm shorter than the predetermined transport amount respectively. The subsequent dots D2 in the block PA-3 are formed after the sheet P has been transported the predetermined transport amount. The subsequent dots D2 in the blocks PA-4 and PA-5 are formed after the sheet P is transported amounts, which are Aμm and (2×A)μm longer than the predetermined transport amount respectively. The scans to form the first-applied dots D1 and the subsequent dots D2 are not limited to ones immediately before and after the sheet P comes out the nip portion. The first-applied dots D1 may be formed in any scan before the sheet P is transported to come out of the nip portion and the subsequent dots D2 may be formed in any scan after the sheet P has been transported and come out of the nip portion.

Figure 7A:
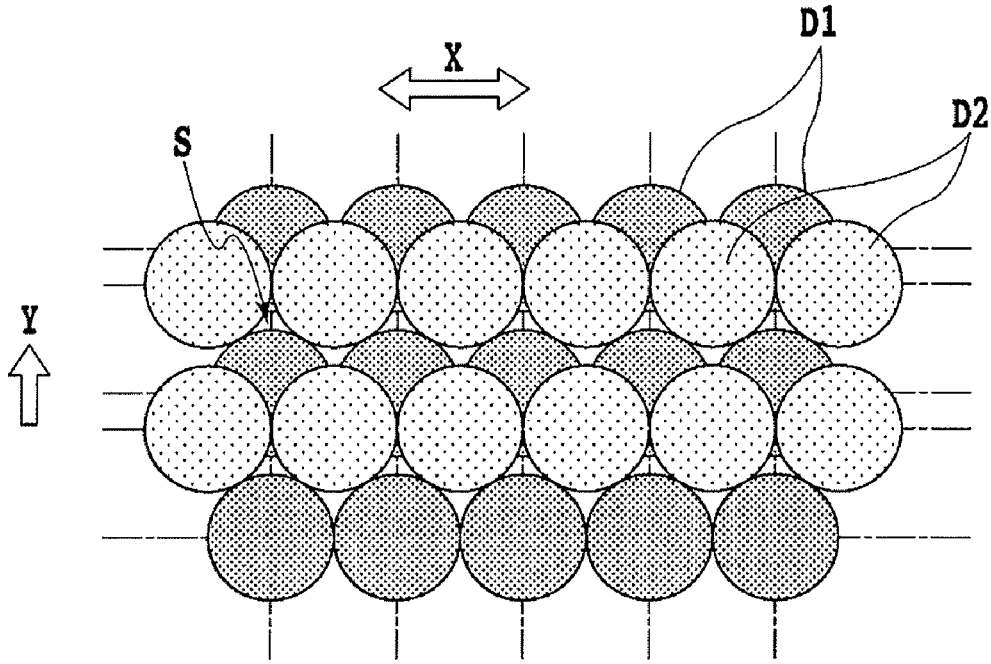
FIGS. 7A and 7B are explanatory diagrams showing other printed test patterns in FIG. 5.
Figure 7B:
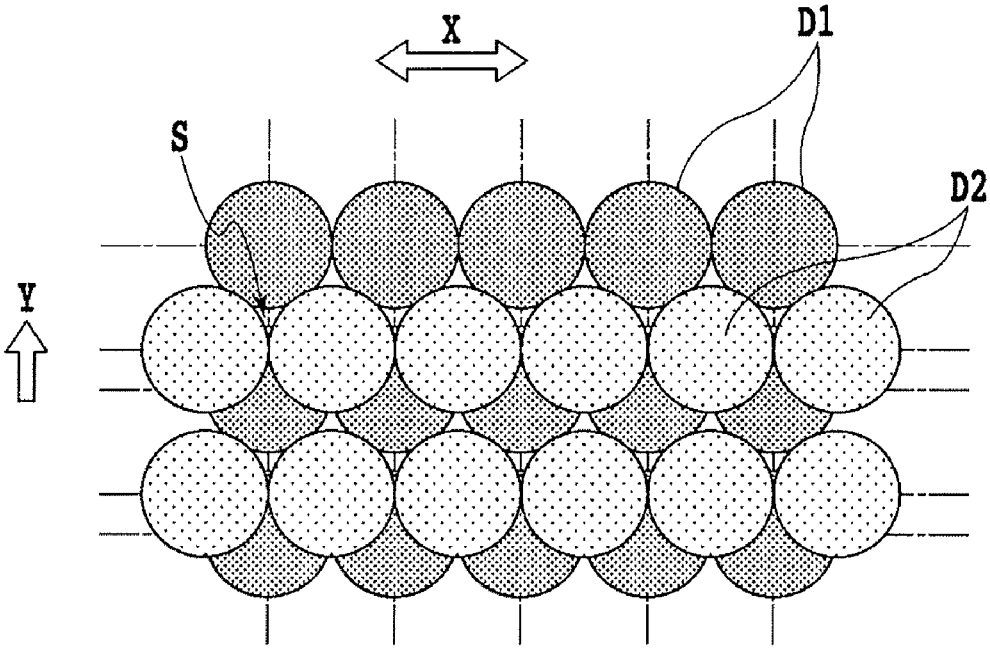

After the test pattern PA has been printed as described above, densities of the pattern blocks are measured by the transport amount correction sensor 53. That is, as the carriage 50 is moved in the main scan direction, the sensor 53 detects the density of the test pattern PA. If the sheet P is correctly fed the predetermined transport amount when the rear end Pr of the sheet P comes out of the nip portion, the dots D1, D2 are formed in the block PA-3 as shown in FIG. 6B. This represents a block with the highest density. In this case, in the block PA-1 and block PA-2 for which the sheet P is transported smaller amounts, the dots D1, D2 are formed as shown in FIG. 7A. In the block PA-4 and block PA-5 for which the sheet P is transported large amounts, the dots D1, D2 are formed as shown in FIG. 7B. In these blocks PA-1, PA-2, PA-4, PA-5 the dots D1, D2 overlap incompletely, leaving unprinted portions S to appear, lowering the density.

Therefore, if the block with the highest density is not PA-3, the correction value for the transport amount when the sheet P comes out of the nip portion can be determined by detecting a block with the highest density. Suppose the block PA-2 has the highest density, for example. Based on the correction value determined by this block, the transport amount of the sheet P is set Aμm smaller than the predetermined transport amount, so that possible degradations in the transporting accuracy when the rear end Pr of the sheet P leaves the transport roller 36 can be minimized. The correction may be done in a manner that corrects the transport amount when the rear end Pr of the sheet P leaves the transport roller 36 so as to reduce a difference between that transport amount and the predetermined transport amount. This method can also minimize the degradations in the transporting accuracy when the rear end Pr of the sheet P leaves the transport roller 36. Such a correction value is stored in the memory in the printing apparatus body.

When in subsequent printing operations a rear end area of the sheet P is printed, the transport amount used when the rear end Pr of the sheet P leaves the nip portion is corrected based on this correction value. As explained above, the transport amount of the sheet P can be corrected by changing, based on such a correction value, the slit position of the encoder attached to the transport motor or the pulse signal representing the number of slits. By minimizing the degradations in the transporting accuracy when the rear end Pr of the sheet P leaves the nip portion between the transport roller 36 and the pinch rollers 37, as described above, a quality image can be printed in the rear end area of the sheet P.

The method of printing the test pattern PA (PA-1 to PA-5) is not limited to the above configuration. For example, the sheet P may be transported Aμm at a time to form the first-applied dots D1 in the blocks PA-1 to PA-5 so that the dots in these blocks are shifted Aμm between the blocks. After this, the sheet P is transported a amount 2 Aμm smaller than the predetermined transport amount. Then, the subsequent dots D2 may be formed in the blocks PA-1 to PA-5 in one scan. In this case, there is no need to transport the sheet Aμm at a time by only the discharge rollers 40, 41 to form the subsequent dots D2. This reduces transporting errors resulting from the transporting of the sheet P by only the discharge rollers 40, 41.

The test pattern PA may also be printed by successively completing the individual blocks PA-1 to PA-5. That is, the PA-1 block is first printed with the first-applied dots D1 and then the sheet P is transported a amount 2 Aμm smaller than the predetermined transport amount, after which the same block is printed with the subsequent dots D2. The sheet P with the PA-1 block printed is again set in the printing apparatus and the next PA-2 block is printed by forming the first-applied dots D1 in the PA-2 block, transporting the sheet P a amount Aμm smaller than the predetermined transport amount and forming the subsequent dots D2 in the PA-2 block. The sheet P with the PA-1 and PA-2 blocks printed is again set in the printing apparatus before proceeding to print the next PA-3 block. That is, after forming the first-applied dots D1 in the PA-3 block, the sheet P is transported the predetermined transport amount and the subsequent dots D2 are formed in the PA-3 block. For the blocks PA-4 and PA-5 the similar printing procedure is performed. By repeating the process of completing the individual blocks PA-1 to PA-5 successively, the test pattern PA is formed. With this test pattern printing method, each time the individual block PA-1 to PA-5 is completed, the sheet transporting is done to cause the rear end Pr of the sheet P to leave the nip portion, as in the normal printing operation. Therefore, based on the same sheet transporting operation as performed during the actual printing operation, the correction value for the transport amount can be determined.

The control to correct the transport amount of the rear end area of the sheet P after having printed the test pattern PA on the sheet may, for example, be performed automatically when the power of the printing apparatus is first turned on. It is also possible to provide a command unit in the printing apparatus 1 (see FIG. 1) and/or in a host device connected to the printing apparatus 1 and to freely perform the correction control on the transport amount of the sheet P according to commands of an operator from the command unit. That is, with the mechanism for printing a test pattern on the print medium (sheet P), the printing apparatus 1 of this embodiment can perform the correction control on the print medium transport amount at a desired timing according to the command from the operator.

Second Embodiment

In the first embodiment, the method of correcting the transport amount when the rear end Pr of the sheet P leaves the transport roller 36 has been explained. In the second embodiment the process of correcting the transport amount when the sheet P is fed only by the discharge rollers 40, 41 after the rear end Pr of the sheet P have left the nip portion between the transport roller 36 and the pinch rollers 37. The construction similar to the one already explained above will be omitted in the following description.

Figure 8:
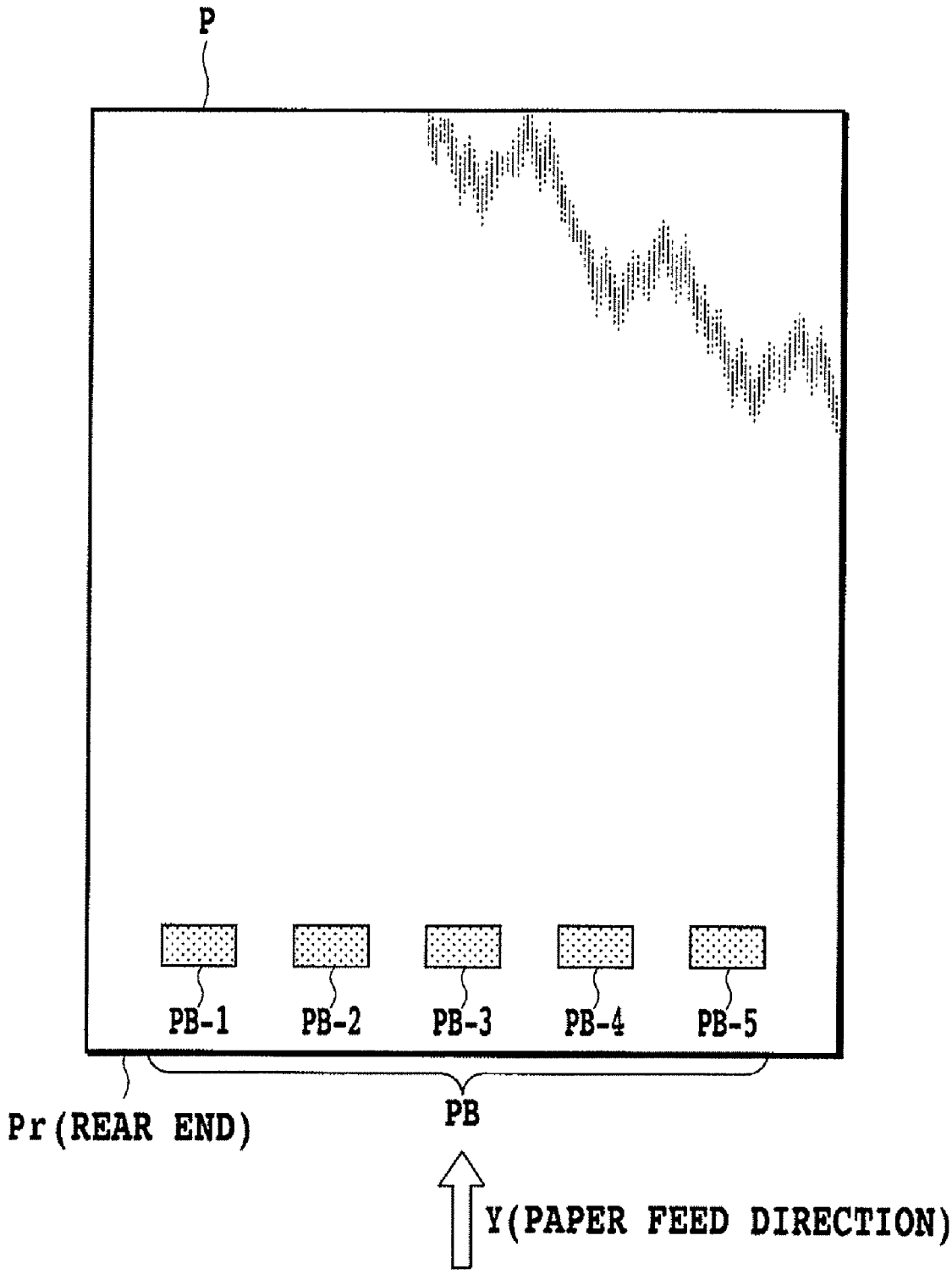
FIG. 8 is an explanatory diagram showing an example of a printed test pattern in a second embodiment of this invention.
Figure 9:
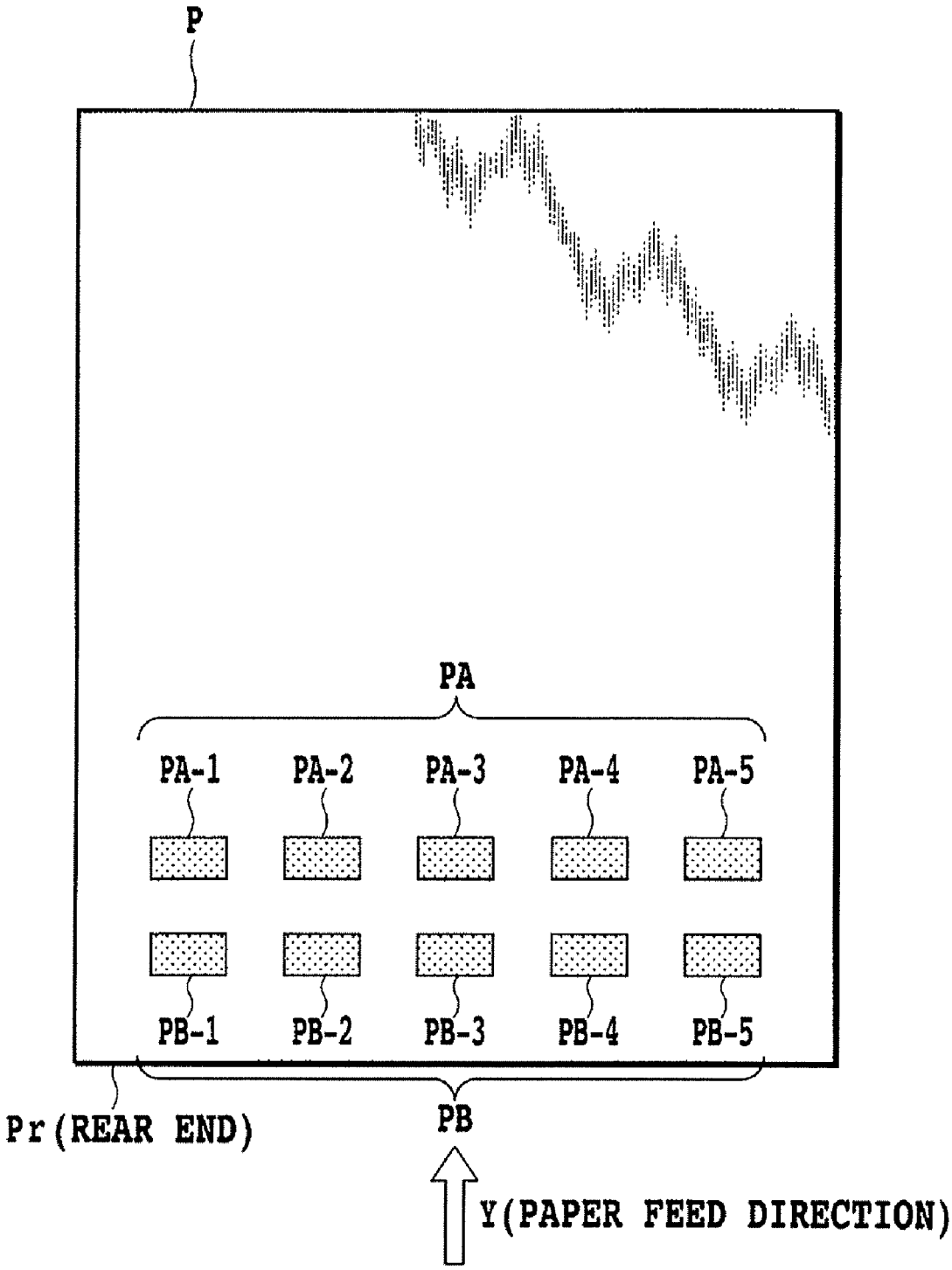
FIG. 9 is an explanatory diagram showing an example of a printed test pattern in a third embodiment of this invention.

In FIG. 8, PB (PB-1 to PB-5) represents a test pattern used to correct a transport amount when the sheet P is fed only by the discharge rollers 40, 41. As with the test pattern PA described above, the test pattern PB is also printed in two scans. This test pattern PB, as shown in FIG. 8, comprises five blocks (PB-1 to PB-5) arrayed near the rear end Pr of the sheet P in the scan direction (X direction) of the carriage 50. This test pattern PB is located closer to the rear end Pr than the position where the test pattern PA is printed.

The printing of the blocks PB-1 to PB-5 in both the first scan and the second scan is performed after the rear end Pr of the sheet P has left the nip portion between the transport roller 36 and the pinch rollers 37. That is, between the two scans the sheet P is transported by only the discharge rollers 40, 41.

First, the rear end Pr of the sheet P is detected by the PE sensor and, based on the detection timing, the time when the rear end Pr comes out of the nip portion between the transport roller 36 and the pinch rollers 37 is determined. Then, after the rear end Pr of the sheet P has come out of the nip portion between the transport roller 36 and the pinch rollers 37, the first-applied dots D1 are formed in the blocks PB-1 to PB-5 of the test pattern PB in the first scan of the print head 7. Then, in the second scan after the sheet P has been transported differing amounts, the subsequent dots D2 are formed in the blocks PB-1 to PB-5 respectively. The amount by which the transport amounts of the sheet P are differentiated may be Aμm as described above, or other value.

After the blocks PB-1 to PB-5 have been completely printed in two scans, their densities are measured by the transport amount correction sensor 53. By detecting a block with the highest density, the correction value for the amount of transporting by the discharge rollers 40, 41 after the rear end Pr of the sheet P has left the nip portion can be determined. This correction value is stored in the memory in the printing apparatus body. In subsequent printing operations, when a rear end area of the sheet P is printed, the transport amount after the rear end Pr of the sheet P has left the nip portion is corrected based on this correction value in such a way that the transport amount is equal to the predetermined transport amount or their difference is reduced. By correcting the transport amount of the sheet P in this manner, it is possible to minimize degradations in the transporting accuracy when the sheet P is transported only by the discharge rollers 40, 41 and thereby print a quality image in the rear end area of the sheet P.

Third Embodiment

Next, a control to correct the transport amount used when the rear end Pr of the sheet P leaves the nip portion between the transport roller 36 and the pinch rollers 37 and a control to correct the transport amount used after the sheet P has left the nip portion will be explained. Such a correction of the transport amount can be executed by combining the constructions of the first embodiment and the second embodiment. That is, from the test pattern PA a correction value for the transport amount of the sheet P used when the rear end Pr of the sheet P leaves the nip portion between the transport roller 36 and the pinch rollers 37 is determined. Then, based on the correction value, the transport amount when the rear end Pr of the sheet P leaves the nip portion of the rollers 36, 37 is corrected. Further, from the test pattern PB, a correction value for the transport amount used when the sheet P is transported only by the discharge rollers 40, 41 after it has left the nip portion is determined. Then, based on the correction value, the transport amount when the sheet P is transported only by the discharge rollers 40, 41 is corrected. Constructions similar to those described above are omitted in the following description.

These test patterns PA, PB for the transport amount correction are printed near the rear end Pr of the sheet P. The test patterns PA (PA-1 to PA-5) and PB (PB-1 to PB-5) are each comprised of five blocks arrayed in the scan direction (X direction) of the carriage 50. PA (PA-1 to PA-5) and PB (PB-1 to PB-5) are shifted in position from each other in the transport direction (Y direction).

First, in the same procedure as in the first embodiment, the test pattern PA is printed on the sheet P. Then, densities of the pattern blocks are measured by the transport amount correction sensor 53. By detecting a block with the highest density, a correction value for the transport amount used when the sheet P leaves the nip portion can be determined as described above. Then, based on the correction value, the transport amount when the rear end Pr of the sheet P leaves the nip portion is corrected in such a way that the transport amount is equal to the predetermined transport amount or their difference is reduced.

Next, the test pattern PB is printed on the sheet P. The procedure for printing the test pattern PB is the same as in the second embodiment. Using the transport amount correction sensor 53, a block with the highest print density is detected from among the blocks PB-1 to PB-5 of the test pattern PB. As a result, a correction value for the transport amount used when the sheet P is transported only by the discharge rollers 40, 41 after the rear end Pr of the sheet P has left the nip portion can be determined. Based on this correction value, the transport amount of the sheet P after the rear end Pr of the sheet P has left the nip portion is corrected in such a way that the transport amount is equal to the predetermined transport amount or their difference is reduced.

From the test pattern PA, a transport amount correction value for the sheet P used when the rear end Pr of the sheet P leaves the nip portion between the transport roller 36 and the pinch rollers 37 (transport means on the upstream side with respect to the transport direction) is determined. Then, based on the correction value, the transport amount used when the rear end Pr of the sheet P leaves the nip portion between the transport roller 36 and the pinch rollers 37 can be corrected. Further, from the test pattern PB, a transport amount correction value used when the sheet P is transported only by the discharge rollers 40, 41 after it has left the nip portion is determined. Then, based on the correction value, the transport amount used when the sheet P is transported only by the discharge rollers 40, 41 can be corrected. As a result, degradations in the transporting accuracy after the rear end of the sheet P has left the transport means on the upstream side with respect to the transport direction can be minimized. This in turn minimizes deteriorations of image quality in the rear end area of the sheet P.

Fourth Embodiment

The printing apparatus of this embodiment has a transport amount sensor 300 to directly measure the distance that the sheet P has moved. With this sensor, it is possible to correct the transport amount used when the rear end Pr of the sheet P leaves the transport means (upstream transport means) on the upstream side with respect to the transport direction and after it has left the upstream transport means. Constructions similar to those described above are omitted in the following description.

The construction having the transport amount sensor 300 is not limited to the correction of the transport amount used when the rear end Pr of the sheet P leaves the upstream transport means and after it has left the upstream transport means. That is, this embodiment can also be applied to correcting the transport amount used when the rear end Pr of the sheet P leaves the nip portion and to correcting the transport amount used after the rear end Pr of the sheet P has left the nip potion.

Figure 10:
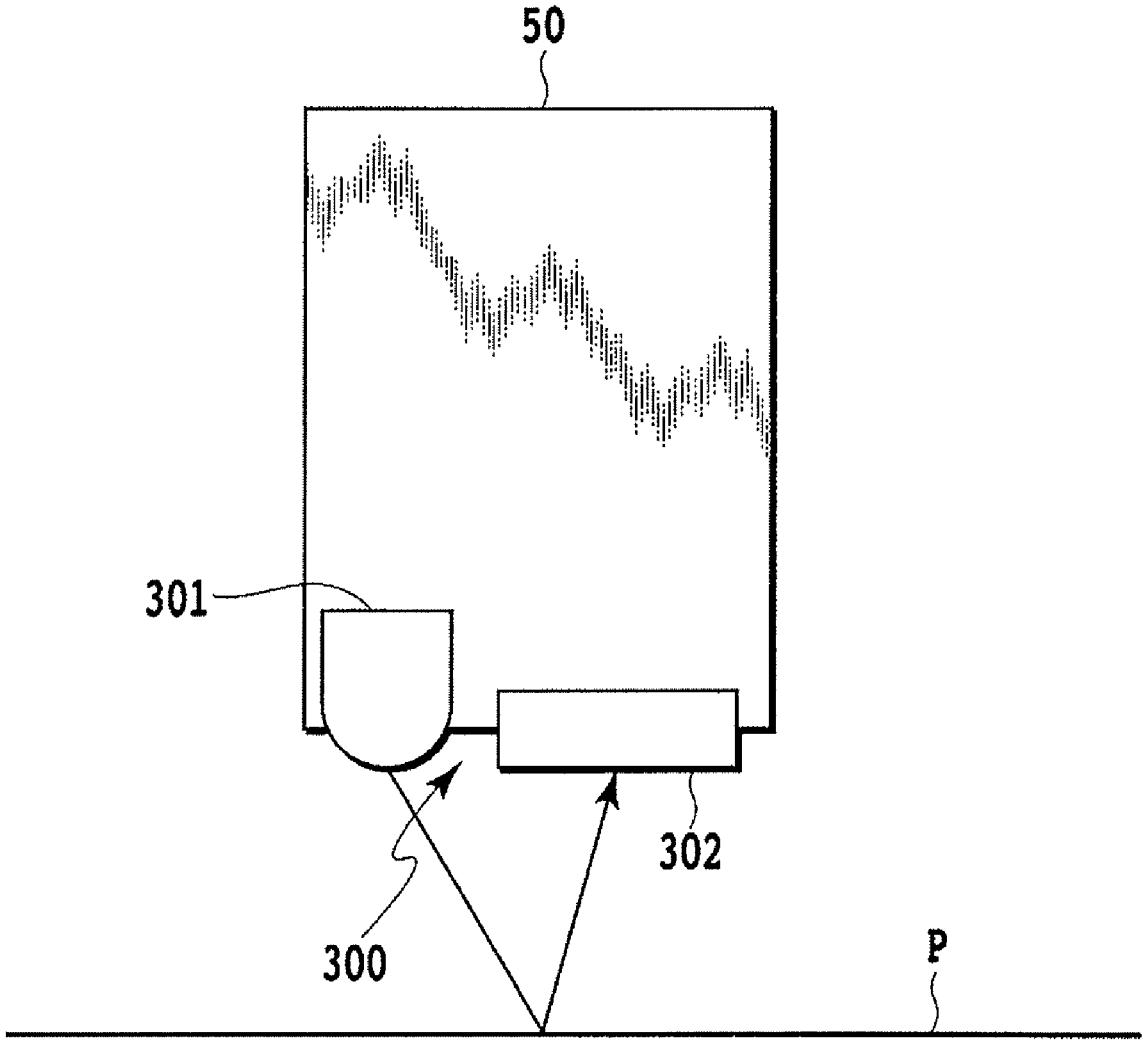
FIG. 10 is an explanatory diagram showing a construction of a transport amount sensor in a fourth embodiment of this invention.

Referring to FIG. 10, an example construction of the transport amount sensor 300 is explained. In the transport amount sensor 300 of this example, an LED 301 as a light source and a light receiver 302 are arranged as shown in FIG. 10. At the position between the transport roller 36 and the discharge rollers 40, 41, the transport amount sensor 300 can directly measure the distance (transport amount) the sheet P has traveled. The transport amount sensor 300 is mounted, for example, on a side surface of the carriage 50 in the printing apparatus 1. Alternatively, the transport amount sensor 300 may be arranged at a position facing the ejection face of the print head 7 to measure the travel amount (transport amount) from the back of the sheet P. As the light receiver 302 may be used a line sensor having light receiving elements arrayed one dimensionally or an area sensor having the light receiving elements arranged two dimensionally. As the light receiving elements, CCD or CMOS may be used.

The transport amount sensor 300 emits light from the LED 301 to the sheet P transporting to the right or left in FIG. 10 during the printing operation and receives reflected light from the sheet P by the light receiver 302 at a predetermined interval. The sheet P is printed with an image by repetitively performing the transporting of the sheet P and the printing scan of the print head 7. Thus, by detecting the printed image on the sheet P by the transport amount sensor 300, the transport amount or travel distance of the sheet P before and after a printing scan can be detected. That is, data of the reflected light taken in from the light receiver 302 at each timing is subjected to image processing to extract features of individual images, determining a distance by which each of the images is deviated from the previous event (previous data intake timing).

Extraction of image features may apply a variety of methods. They may include, for example, a method involving Fourier-transforming the data taken in from the light receiver 302 and checking a match at each frequency, or a method involving extracting only a peak of the data and determining a positional deviation of that peak. Another popular method involves binarizing the data of the printed image taken in and checking a match with binarized pattern. In any of these methods it is also possible to determine an instantaneous value of a transporting speed of the sheet P from the sheet travel distance per unit time obtained or calculate acceleration from a change in the transporting speed.

The use of the reflection type optical sensor enables the measurement of the transporting speed and travel amount (transport amount) of the sheet P at each unit time. At this point this embodiment differs greatly from the embodiment that uses a rotary angle sensor. The rotary angle sensor measures the time it takes for the sheet to move a unit distance (unit rotary angle), so it is difficult to perform a highly precise control during a low-speed operation. With this embodiment, however, the transport amount of the sheet P can be determined with a stable accuracy whatever the transporting speed of the sheet P.

In performing the printing operation, the rear end Pr of the sheet P is detected by the PE sensor to determine the timing at which the rear end Pr of the sheet P leaves the nip portion between the transport roller 36 and the pinch rollers 37. Then, using the transport amount sensor 300, the transport amount appearing before the rear end Pr of the sheet P leaves the nip portion, the transport amount appearing when it leaves the nip portion and the transport amount appearing after it has left the nip portion are measured. Based on differences among these measured transport amount, the transport amount used when the rear end Pr of the sheet P leaves the nip portion and the transport amount after it has left the nip portion are corrected.

By correcting the transport amount as the rear end area of the sheet is printed, as described above, degradations in transporting accuracy that may occur when the rear end Pr of the sheet P leaves the upstream transport means and after it has left the upstream transport means can be minimized. As a result, image deteriorations in the rear end area of the sheet P can be suppressed.

The control to correct the transport amount of the rear end area of the sheet P by directly measuring the transport amount of the sheet P, as described above, may be performed automatically, for example, when the power of the printing apparatus is first turned on. It is also possible to provide a command unit in the printing apparatus 1 or in a host device connected to the printing apparatus 1 and to freely perform the correction control on the transport amount of the sheet P according to commands of an operator from the command unit. That is, using the detection mechanism such as the transport amount sensor 300, the printing apparatus 1 of this embodiment can perform the correction control on the transport amount at a desired timing according to the command from the operator.

Fifth Embodiment

In this embodiment, an operator recognizes a printed result of a test pattern for correcting a transport amount of the rear end of the sheet P and enters a result of his or her check.

Figure 11:
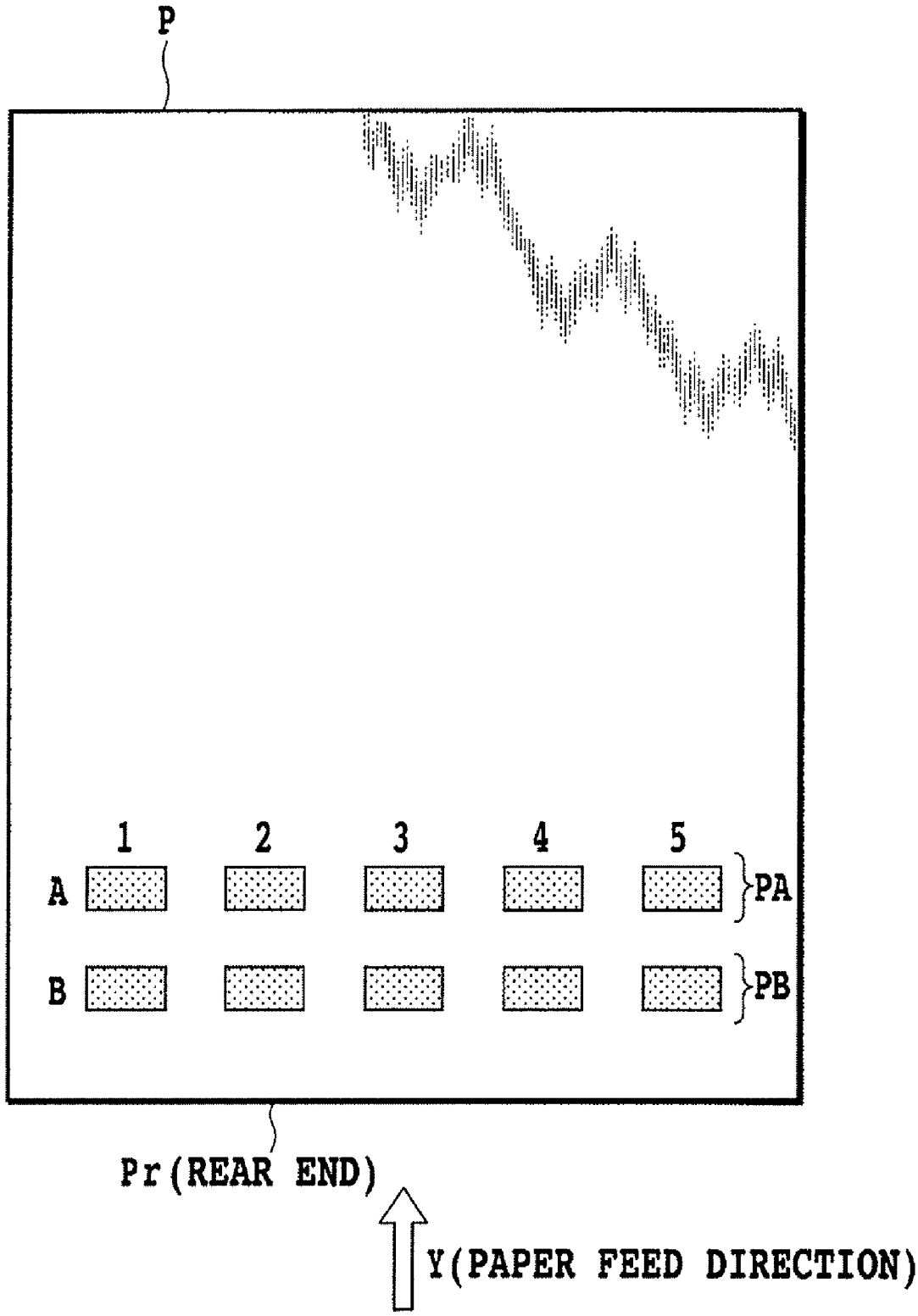
FIG. 11 is an explanatory diagram showing an example of a printed test pattern in a fifth embodiment of this invention.

In this embodiment test patterns PA, PB are printed as shown in FIG. 11. That is, to ensure that the blocks in the test patterns can clearly be checked, the sheet P is printed with reference symbols A and B at the upper and lower tiers of the test pattern and also with reference numbers 1, 2, 3, 4 and 5 for columns of blocks arranged from left to right, in addition to the test patterns PA, PB.

Figure 12:
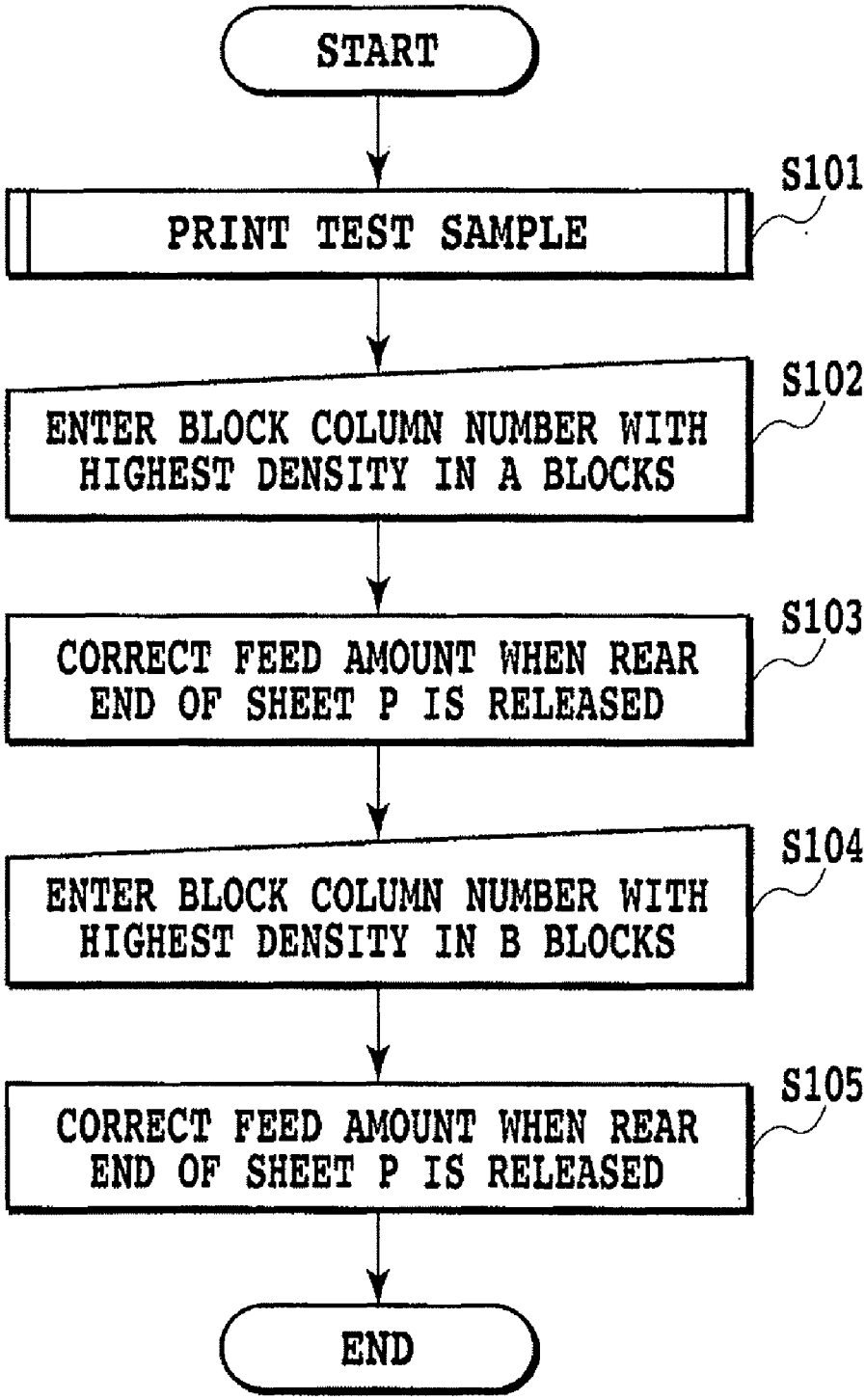
FIG. 12 is a flow chart showing a method of correcting a transport amount in the fifth embodiment of this invention.

FIG. 12 is a flow chart showing the process of correcting the transport amount by using such test patterns. First, a test sample is printed which includes the test patterns PA, PB, reference symbols A, B and reference numbers 1-5 (step 101). The operator checks the printed result of the test sample, finds a block with the highest density from among the A blocks of the test pattern PA, and enters the column number of that block (step 102). According to the input value entered, the transport amount is corrected (step 103) to secure the transporting accuracy when the rear end of the sheet P leaves the transport roller 36. Next, the operator determines a block with the highest density from among the B blocks of the test pattern PB and enters a column number of that block (step 104). As a result, the transport amount is corrected according to the value entered (step 105), thus securing the transporting accuracy after the rear end of the sheet P has left the transport roller 36.

The information on the test patterns that the operator enters may be entered from an operation unit provided in the printing apparatus 1. The printing apparatus 1 can correct the transport amount according to the value entered and thus prevent possible degradations of image in the rear end area of the sheet P. Alternatively, the operator may enter information on the test pattern into a host device connected to the printing apparatus 1 and transfer this information from the host device to the printing apparatus 1 for the similar processing described above.

With this embodiment, there is no need to provide the transport amount correction sensor 53 in the printing apparatus, so the cost of the printing apparatus can be lowered. Other constructions and actions are similar to those of the preceding embodiments.

It is noted that this embodiment is not limited to a case where both of the test pattern PA for correcting the transport amount used when the rear end Pr of the sheet P leaves the transport roller 36 and the test pattern PB used to correct the transport amount after the rear end Pr of the sheet P has left the transport roller 36 are printed. That is, this embodiment can also be applied to cases where only the test pattern PA or only the test pattern PB is printed.

Other Embodiments

The correction of the transport amount performed on the rear end area of the sheet P, described in the first to fifth embodiment, may be combined with the method disclosed in Japanese Patent Laid-Open No. 2002-254736. That is, based on a change in the transport amount appearing when the rear end Pr of the sheet P leaves the nip portion, the transport amount associated with the rear end area of the sheet P is corrected and at the same time the range of nozzles in the print head 7 that can be used is limited to reduce the transport amount associated with the rear end area of the sheet P. Further, with this construction the transporting accuracy of the rear end area of the sheet P can be enhanced compared with that of Japanese Patent Laid-Open No. 2002-254736, making it possible to increase the number of nozzles to be operated and the transport amount to give a priority to the printing speed.

The printing apparatus of this invention may have a construction for printing test patterns on a print medium and a mechanism such as a transport amount sensor for detecting a difference between transport amounts. The latter mechanism is one that detects a difference between a transport amount appearing before the sheet P leaves the nip portion of the transport means disposed on the upstream side with respect to the transport direction and a transport amount appearing when the sheet P leaves the nip portion or appearing after it has left the nip portion. With this construction, it is possible to correct the transport amount according to the operating condition of the printing apparatus even if the transport amount changes due to changing conditions of the printing apparatus when the sheet P leaves the nip portion or after it has left the nip portion. The operating condition of the printing apparatus varies when a roller diameter changes with temperature and humidity variations or when a roller friction coefficient changes as the number of sheets printed increases.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-362426, filed Dec. 15, 2006, and Japanese Patent Application No. 2006-271189, filed Oct. 2, 2006, which are hereby incorporated by reference herein in their entirety.

What is claimed is:

1. A printing apparatus for printing an image on a print medium by repetitively performing a scan operation that scans a print head in a scan direction and a transport operation that transports the print medium in a transport direction crossing the scan direction, the printing apparatus comprising:

first transport means for transporting the print medium, the first transport means being installed upstream of the print head with respect to the transport direction;

second transport means for transporting the print medium, the second transport means being installed downstream of the print head with respect to the transport direction;

printing means for printing on the print medium a test pattern used to detect a transporting error in a second transporting operation, the second transporting operation transporting the print medium in which a transporting state is between a transporting state of a first transporting operation and a transporting state of a third transporting operation, the first transporting operation transporting the print medium by the first transport means and the second transport means, the third transporting operation transporting the print medium not by the first transport means but by the second transport means; and correction means for correcting a transport amount in the second transporting operation based on a printed result of the test pattern, wherein the test pattern includes a plurality of first patterns printed before the second transporting operation and a plurality of second patterns printed after the second transporting operation, and wherein the print medium is transported by the first transporting operation between printing operations for the plurality of first patterns.

2. A printing apparatus according to claim 1, further comprising a sensor for measuring print densities.

3. A printing method for printing an image on a print medium by repetitively performing a scan operation that scans a print head in a scan direction and a transport operation that transports the print medium in a transport direction crossing the scan direction, the printing method comprising the steps of:

transporting the print medium by first transport means installed upstream of the print head with respect to the transport direction or by second transport means installed downstream of the print head with respect to the transport direction;

printing on the print medium a test pattern used to detect a transporting error in a second transporting operation, the second transporting operation transporting the print medium in which a transporting state is between a transporting state of a first transporting operation and a transporting state of a third transporting operation, the first transporting operation transporting the print medium by the first transport means and the second transport means, the third transporting operation transporting the print medium not by the first transport means but by the second transport means; and correcting the transport amount in the second transporting operation based on a printed result of the test pattern, wherein the test pattern includes a plurality of first patterns printed before the second transporting operation and a plurality of second patterns printed after the second transporting operation, and wherein in the printing step the print medium is transported by the first transporting operation between printing operations for the plurality of first patterns.

* * * * *